US009215019B2

(12) United States Patent
Jiang et al.

(10) Patent No.: US 9,215,019 B2
(45) Date of Patent: Dec. 15, 2015

(54) METHOD AND APPARATUS FOR INTERFERENCE CANCELLATION IN HYBRID SATELLITE-TERRESTRIAL NETWORK

(75) Inventors: Hong Jiang, Warren, NJ (US); Liangkai Yu, New Providence, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 257 days.

(21) Appl. No.: 13/564,840

(22) Filed: Aug. 2, 2012

(65) Prior Publication Data

US 2013/0208655 A1 Aug. 15, 2013

Related U.S. Application Data

(60) Provisional application No. 61/597,993, filed on Feb. 13, 2012.

(51) Int. Cl.

| | |
|---|---|
| ***H04H 20/67*** | (2008.01) |
| ***H04H 20/06*** | (2008.01) |
| ***H04H 20/72*** | (2008.01) |
| ***H04H 20/74*** | (2008.01) |
| *H04H 40/90* | (2008.01) |
| *H04H 20/22* | (2008.01) |

(52) U.S. Cl.

CPC ..... *H04H 20/67* (2013.01); *H04H 20/06* (2013.01); *H04H 20/72* (2013.01); *H04H 20/74* (2013.01); *H04H 20/22* (2013.01); *H04H 40/90* (2013.01)

(58) Field of Classification Search

CPC ..... H04B 7/18563; H04B 7/18513; H04B 7/216; H04B 7/18543; H04B 7/1853

See application file for complete search history.

(56) References Cited

U.S. PATENT DOCUMENTS

| | | | |
|---|---|---|---|
| 6,125,124 | A | 9/2000 | Junell et al. |
| 6,236,695 | B1 | 5/2001 | Taylor |
| 6,459,745 | B1 | 10/2002 | Moose et al. |
| 6,510,308 | B1 | 1/2003 | Thomas et al. |
| 6,684,057 | B2 | 1/2004 | Karabinis |
| 6,859,641 | B2 | 2/2005 | Collins et al. |

(Continued)

FOREIGN PATENT DOCUMENTS

| | | |
|---|---|---|
| EP | 0227393 | 12/1986 |
| EP | 0772310 | 5/1997 |

(Continued)

OTHER PUBLICATIONS

Fang Zhi et al., "A Frequency Offset Estimation Algorithm for OFDM Systems", Journal of Electronics (CHINA), vol. 25, No. 1, Jan. 2008.

(Continued)

*Primary Examiner* — Jung Park

(74) *Attorney, Agent, or Firm* — Harness, Dickey & Pierce, P.L.C.

(57) ABSTRACT

In a method for cancelling interference caused by a terrestrial transmitter at a satellite receiver in a hybrid satellite-terrestrial network, a satellite receiver generates an interference cancellation signal based on a reference terrestrial signal from the terrestrial transmitter and a received over-the-air (OTA) signal. The satellite receiver then cancels the interference caused by the terrestrial transmitter by combining the interference cancellation signal with the received OTA signal. The interference cancellation signal is a modified version of the reference terrestrial signal.

19 Claims, 5 Drawing Sheets

(56) References Cited

U.S. PATENT DOCUMENTS

| | | | | |
|---|---|---|---|---|
| 7,747,292 | B2 * | 6/2010 | Mezer et al. | 455/570 |
| 8,116,419 | B2 | 2/2012 | Jiang et al. | |
| 8,401,509 | B1 * | 3/2013 | Gupta et al. | 455/296 |
| 2002/0039383 | A1 | 4/2002 | Zhu et al. | |
| 2002/0181438 | A1 | 12/2002 | McGibney | |
| 2002/0197958 | A1 | 12/2002 | Collins et al. | |
| 2003/0052819 | A1 * | 3/2003 | Jacomb-Hood et al. | 342/379 |
| 2004/0142660 | A1 * | 7/2004 | Churan | 455/12.1 |
| 2005/0041693 | A1 | 2/2005 | Priotti | |
| 2005/0129149 | A1 | 6/2005 | Kuntz | |
| 2006/0036365 | A1 * | 2/2006 | Chiayee et al. | 701/213 |
| 2006/0088133 | A1 | 4/2006 | Chen et al. | |
| 2010/0008458 | A1 | 1/2010 | Jiang et al. | |
| 2011/0130091 | A1 * | 6/2011 | Sombrin et al. | 455/13.4 |
| 2011/0181463 | A1 * | 7/2011 | Chopard et al. | 342/357.26 |

FOREIGN PATENT DOCUMENTS

| | | |
|---|---|---|
| EP | 1724946 | 11/2006 |
| EP | 1734679 | 12/2006 |
| KR | 102006001436 | 2/2006 |

OTHER PUBLICATIONS

"System Specifications for Satellite Services to Handheld Devices (SH) below 3 GHz", Digital Video Broadcasting, DVB.

Stein, S., "Algorithms for Ambiguity Function Processing," IEEE Transactions on Acoustics, Speech, and Signal Processing, Col. ASSP-29, No. 3, Part 02, pp. 588-599, Jun. 1, 1981.

Hong Jiang et al., "A Correlation for the Detection of Time and Frequency Offsets: Appendix II", IEEE Transactions on Broadcasting. vol. 55, No. 4, pp. 752-760, Dec. 2009.

International Search Report dated Nov. 4, 2009.

Written Opinion dated Nov. 4, 2009.

International Preliminary Report on Patentability, dated Jan. 27, 2011, issued in International Application No. PCT/US2009/003881.

International Search Report and Written Opinion for corresponding International Patent Application No. PCT/US2013/025014 dated Mar. 20, 2013.

Daniel Sauvet-Goichon, "Planning Aspects of Satellite and Terrestrial Digital Sound Broadcasting", International Journal of Satellite Communications, vol. 13, pp. 215-221, Jan. 1, 1995.

International Preliminary Report and Written Opinion for corresponding International Patent Application No. PCT/US2013/025014 mailed Aug. 28, 2014.

Korean Office Action mailed Jun. 19, 2015.

* cited by examiner

METHOD AND APPARATUS FOR INTERFERENCE CANCELLATION IN HYBRID SATELLITE-TERRESTRIAL NETWORK

CROSS-REFERENCE TO RELATED APPLICATION(S)

This application claims priority under 35 U.S.C. §119(e) to U.S. provisional application No. 61/597,993, filed on Feb. 13, 2012, the entire contents of which is incorporated herein by reference.

BACKGROUND

A single frequency network (SFN) is a broadcast network in which several transmitters simultaneously transmit the same signal over the same frequency channel. One type of conventional SFN is known as a hybrid satellite-terrestrial SFN. An example hybrid SFN is defined in the Digital Video Broadcasting (DVB) standard "Framing Structure, channel coding and modulation for Satellite Services to Handheld devices (SH) below 3 GHz," ETSI EN 302 583 V1.1.2 (February 2010).

In these types of networks, the terrestrial transmitter usually needs certain information that is contained in the satellite signal in order for the terrestrial transmitter to generate and transmit the terrestrial signal properly.

In a conventional hybrid satellite-terrestrial network, such as a Digital Video Broadcasting Satellite Services to Handheld devices (DVB-SH) SFN, if the satellite signal and terrestrial signal are transmitted in identical (or alternatively adjacent) frequency bands, then required satellite information cannot be recovered from the satellite signal using a receiving antenna situated relatively close to the location of the terrestrial transmitter due to radio-frequency (RF) interference caused by the terrestrial transmitter. Consequently, at the site of a terrestrial transmitter, the satellite signal is often too weak relative to the signal from the terrestrial transmitter to be decoded for recovery of the required satellite information directly from the over-the-air (OTA) signal received on site. Because of this, the required information about the satellite signal is obtained at a location remote to the terrestrial transmitter, and transmitted to the site of the terrestrial transmitter via some other network. This other network is sometimes referred to as an "auxiliary" network. However, auxiliary networks such as these can be relatively expensive and/or inaccurate.

SUMMARY

At least some example embodiments provide methods and apparatuses for interference cancellation in a hybrid satellite-terrestrial network. In at least one example embodiment, initially the terrestrial transmitter does not transmit a signal. Therefore, the terrestrial transmitter does not cause interference to the satellite signal component/portion of a composite over-the-air (OTA) signal. Thus, the satellite receiver is able to decode the satellite signal component of the OTA signal, and provide required satellite information to the terrestrial transmitter for transmitting the terrestrial signal.

The terrestrial transmitter is then turned on and the output power is gradually increased. With relatively low power interference from the terrestrial transmitter, the composite OTA signal has a satellite signal portion that is strong enough for the required satellite information carried by the satellite signal portion to be decoded by the satellite receiver. Thus, the terrestrial transmitter can continue using the required information from the decoded satellite signal when transmitting the terrestrial signal.

At the same time, the composite OTA signal is processed by the interference cancellation block to detect the timing, phase, amplitude, frequency offset, and other channel characteristics of the terrestrial signal portion. With timing, phase, amplitude and other channel characteristics of the terrestrial signal portion, plus the required satellite information from the satellite signal decoder, or otherwise available on site, the interference cancellation block generates a modified version of the terrestrial signal portion of the received OTA signal as an interference cancellation signal.

The interference cancellation signal is combined with the composite OTA signal to suppress interference caused by the terrestrial transmitter at the satellite receiver so that the satellite signal decoder is able to continue to receive a relatively clean satellite signal portion from which to extract required satellite information.

As the output power of the terrestrial transmitter increases, the interference cancellation block continues to detect and track the timing, phase, amplitude and other channel characteristics of the terrestrial signal portion to generate the interference cancellation signal so that interference caused by the terrestrial transmitter is suppressed, or significantly attenuated. Accordingly, a relatively clean satellite signal component is input to the satellite signal decoder (e.g., continuously at all times).

At least one example embodiment provides a method for cancelling interference caused by a terrestrial transmitter at a satellite receiver in a hybrid satellite-terrestrial network. According to at least this example embodiment, the method includes: generating, at the satellite receiver, an interference cancellation signal based on a reference terrestrial signal from the terrestrial transmitter and a received over-the-air (OTA) signal, the interference cancellation signal being a modified version of the reference terrestrial signal; and cancelling, at the satellite receiver, the interference caused by the terrestrial transmitter by combining the interference cancellation signal with the received OTA signal.

At least one other example embodiment provides a satellite receiver. According to at least this example embodiment, the satellite receiver includes an interference cancellation block and a combiner. The interference cancellation block is configured to generate an interference cancellation signal based on a reference terrestrial signal from the terrestrial transmitter and a received over-the-air (OTA) signal. The interference cancellation signal is a modified version of the reference terrestrial signal. The combiner is configured to combine the interference cancellation signal with the received OTA signal to cancel interference caused by a terrestrial transmitter in a hybrid satellite-terrestrial network.

BRIEF DESCRIPTION OF THE DRAWINGS

The present invention will become more fully understood from the detailed description given herein below and the accompanying drawings, wherein like elements are represented by like reference numerals, which are given by way of illustration only and thus are not limiting of the present invention.

Figure 1:
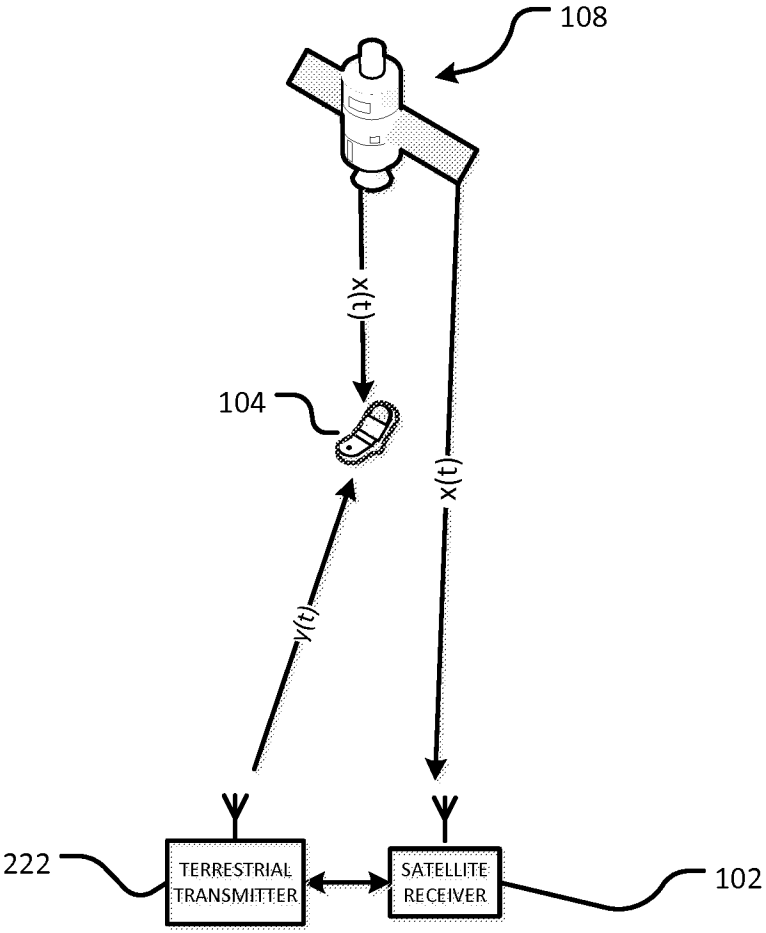
FIG. 1 illustrates a portion of a hybrid satellite and terrestrial network.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF EMBODIMENTS

Various example embodiments of the present invention will now be described more fully with reference to the accompanying drawings in which some example embodiments of the invention are shown.

Detailed illustrative embodiments of the present invention are disclosed herein. However, specific structural and functional details disclosed herein are merely representative for purposes of describing example embodiments of the present invention. This invention may, however, may be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Specific details are provided in the following description to provide a thorough understanding of example embodiments. However, it will be understood by one of ordinary skill in the art that example embodiments may be practiced without these specific details. For example, systems may be shown in block diagrams in order not to obscure the example embodiments in unnecessary detail. In other instances, well-known processes, structures and techniques may be shown without unnecessary detail in order to avoid obscuring example embodiments.

Also, it is noted that example embodiments may be described as a process depicted as a flowchart, a flow diagram, a data flow diagram, a structure diagram, or a block diagram. Although a flowchart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, a function, a procedure, a subroutine, a subprogram, etc. When a process corresponds to a function, its termination may correspond to a return of the function to the calling function or the main function.

Moreover, as disclosed herein, the term "buffer" may represent one or more devices for storing data, including random access memory (RAM), magnetic RAM, core memory, and/or other machine readable mediums for storing information. The term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" may include, but is not limited to, portable or fixed storage devices, optical storage devices, wireless channels and various other mediums capable of storing, containing or carrying instruction(s) and/or data.

Furthermore, example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a storage medium. A processor(s) may perform the necessary tasks.

A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

As discussed herein, the notation "x(t)," "y(t)" and "z(t)" refer to signals that have been processed with appropriate radio frequency (RF) modulation (e.g., orthogonal frequency division multiplexing (OFDM) modulation or the like) for transmission/reception over-the-air. By contrast, the notation "$x_n$," "$y_n$" and "$z_n$" refer to digital signals including frames and/or blocks of samples. The digital signals "$x_n$," "$y_n$" and "$z_n$" are digital representations of the corresponding RF signals x(t), y(t) and z(t).

As described herein, x(t) refers to a satellite signal (sometimes referred to herein as an "analog satellite signal"), whereas y(t) refers to a terrestrial signal (sometimes referred to herein as an "analog terrestrial signal" or "reference terrestrial signal"). A combination or composite of the satellite signal x(t) and the terrestrial signal y(t) is referred to as an over-the-air (OTA) composite signal z(t). In some instances, the over-the-air (OTA) composite signal z(t) is referred to as an "analog OTA composite signal," an "OTA signal," and/or a "composite signal."

At least one example embodiment provides a method for cancelling interference caused by a terrestrial transmitter at a satellite receiver in a hybrid satellite-terrestrial network. According to at least this example embodiment, the satellite receiver generates an interference cancellation signal based on a reference terrestrial signal from the terrestrial transmitter and a received over-the-air (OTA) signal. The interference cancellation signal is a modified version of the reference terrestrial signal. The satellite receiver then cancels the interference caused by the terrestrial transmitter by combining the interference cancellation signal with the received OTA signal.

At least one other example embodiment provides a satellite receiver. According to at least this example embodiment, the satellite receiver includes an interference cancellation block and a combiner. The interference cancellation block is configured to generate an interference cancellation signal based on a reference terrestrial signal from the terrestrial transmitter and a received over-the-air (OTA) signal. The interference cancellation signal is a modified version of the reference terrestrial signal. The combiner is configured to combine the interference cancellation signal with the received OTA signal to cancel interference caused by a terrestrial transmitter in a hybrid satellite-terrestrial network.

FIG. 1 illustrates a portion of a hybrid satellite and terrestrial network.

Referring to FIG. 1, data is provided from a network (not shown), then to the mobile receiver 104 via a terrestrial signal y(t) transmitted by the terrestrial transmitter 222 over a wireless link. A satellite signal x(t) carrying the same data is transmitted from the network to the satellite 108, and then to the mobile receiver 104.

The signals x(t) and y(t) are derived from, and carry, satellite information. The satellite information may include payload data, which is data to be provided/transmitted to the mobile receiver 104. In one example, the payload data may include, for example, multimedia content (e.g., voice, video, pictures, etc.) as well as signal transmission or channel characteristic information (e.g., frequency and timing offset information).

As mentioned above, in a hybrid satellite and terrestrial network, such as that shown in FIG. 1, the terrestrial transmitter 222 requires information regarding the satellite signal received via the satellite 108 in order to function coherently with the satellite portion of the network. To provide this information, a satellite receiver 102 is located relatively close to the terrestrial transmitter 222. In at least one example embodiment, the satellite receiver 102 may be co-located with the terrestrial transmitter 222.

In conventional satellite radio networks, a satellite receiver is co-located with a terrestrial transmitter. In one example, the satellite receiver discussed herein replaces the conventional satellite receiver in conventional satellite radio networks.

In a conventional Digital Video Broadcasting Satellite Services to Handheld devices (DVB-SH) network, there is no satellite receiver co-located with the terrestrial transmitter. According to at least some example embodiments, a satellite receiver is added at the site of the terrestrial transmitter so that the satellite receiver and the terrestrial transmitter are co-located with one another.

An example embodiment of the satellite receiver 102 and the terrestrial transmitter 222, as well as their interaction with one another, will be discussed in more detail below with regard to FIGS. 2 through 4.

Figure 2:
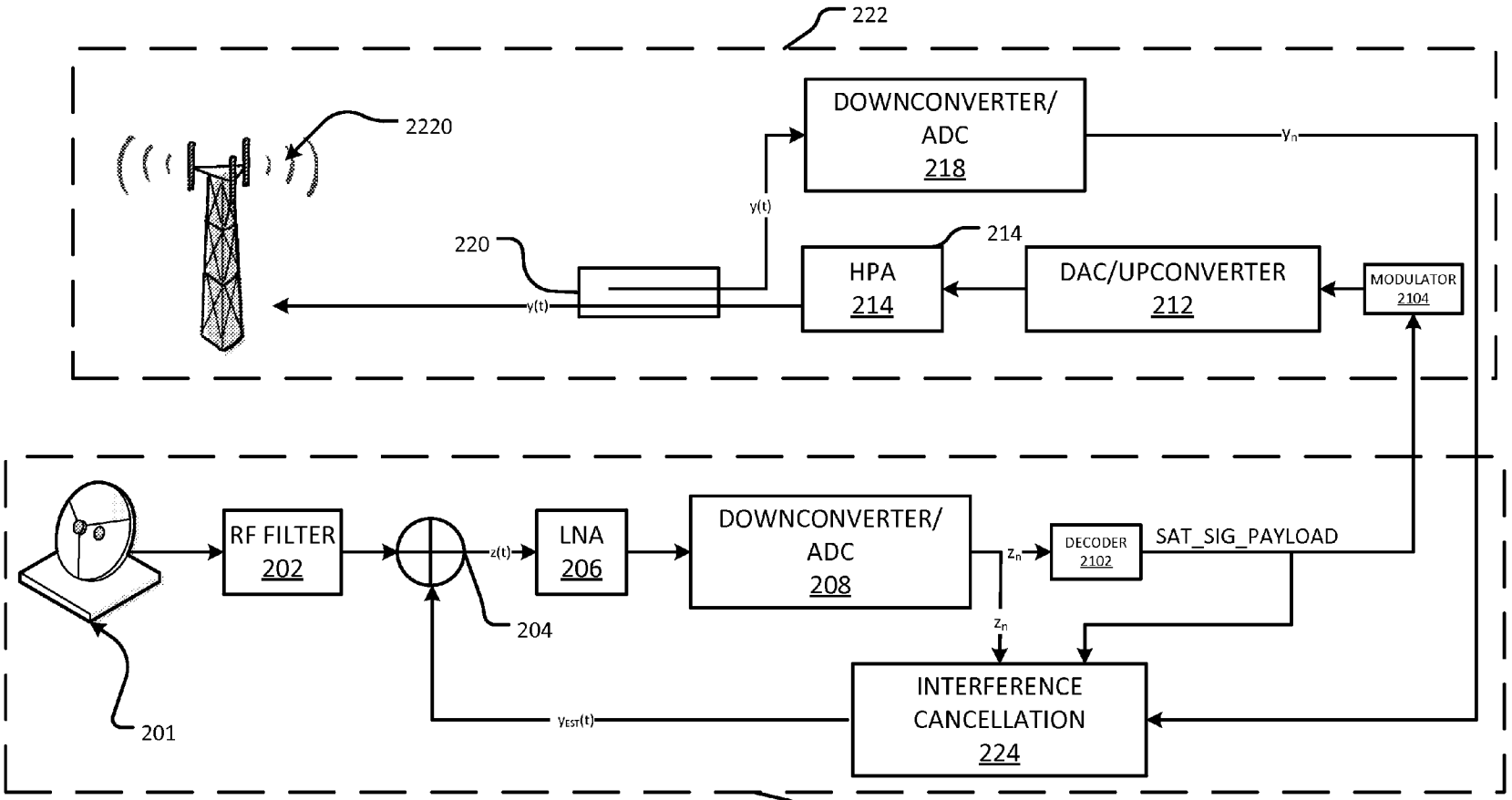
FIG. 2 is a block diagram illustrating an example embodiment of a terrestrial transmitter and a satellite receiver in more detail.

FIG. 2 is a block diagram illustrating an example embodiment of the satellite receiver 102 and the terrestrial transmitter 222 in more detail. FIG. 4 is a flow chart illustrating example operation of the satellite receiver 102 and terrestrial transmitter 222 shown in FIG. 2. The method shown in FIG. 4 is an example embodiment of a method for interference cancellation. For example purposes, the satellite receiver 102 and the terrestrial transmitter 222 will be described with regard to the method shown in FIG. 4 and vice-versa.

In addition to the functions/acts described herein, it should be understood that the satellite receiver 102 and the terrestrial transmitter 222 are also capable of performing conventional, well-known functions of conventional satellite receivers and terrestrial transmitters in a hybrid satellite-terrestrial network. Because such functions are well-known in the art, a detailed discussion is omitted.

Figure 4:
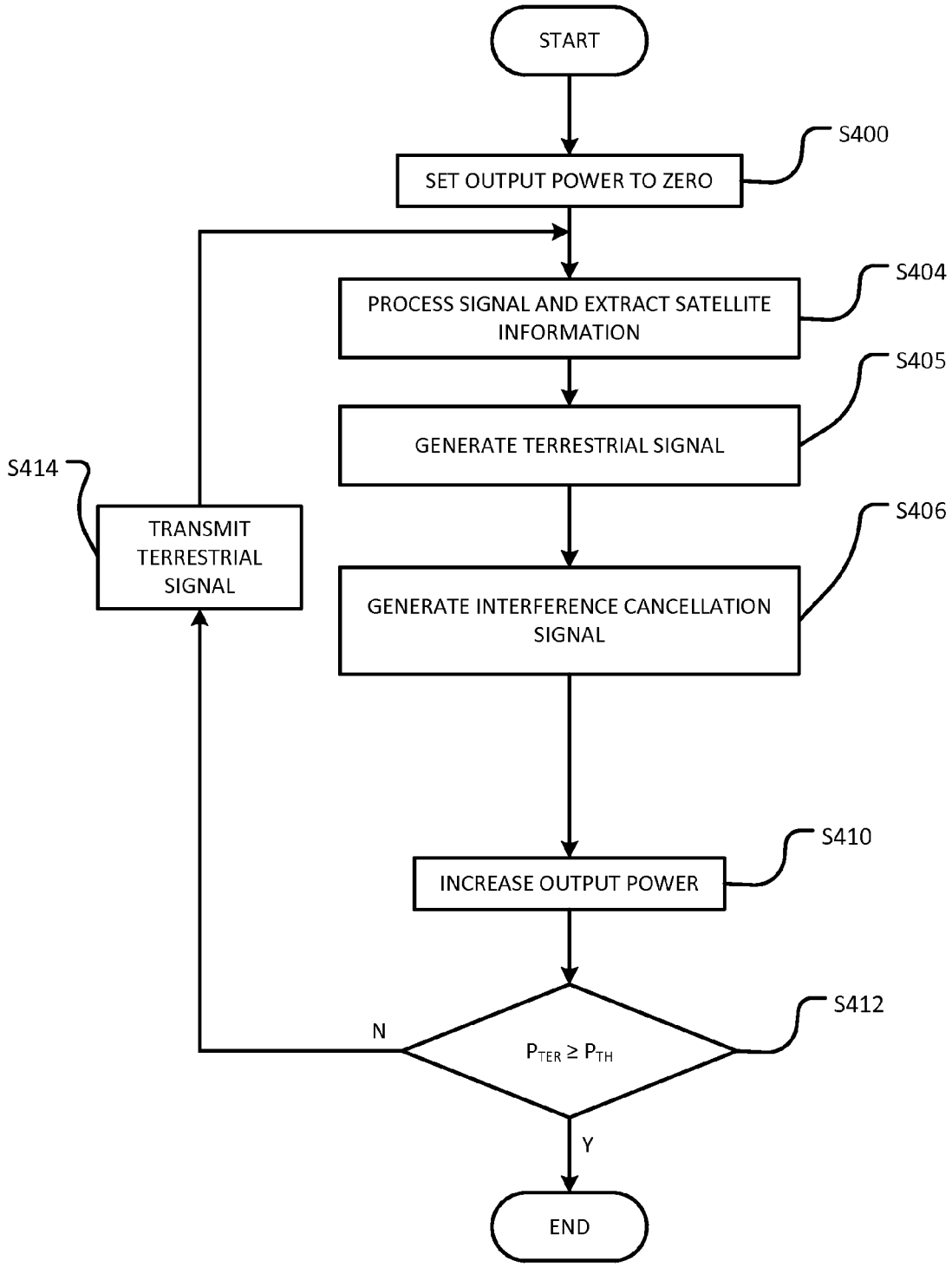
FIG. 4 is a flow chart illustrating an example embodiment of a method for interference cancellation in a hybrid satellite-terrestrial network.

Referring to FIGS. 2 and 4, initially, at step S400 the terrestrial transmitter 222 sets the transmission (or output) power of the terrestrial signal y(t) from the terrestrial transmitter antenna 2220 to zero. In this initial iteration of the process shown in FIG. 4, the terrestrial transmitter 222 does not transmit the terrestrial signal y(t). As a result, the satellite receiver antenna 201 of the satellite receiver 102 receives the satellite signal x(t) without interference from the terrestrial transmitter 222.

At step S404, the satellite receiver 102 processes the composite OTA signal z(t) and extracts satellite information. In this example, the satellite information includes payload data SAT_SIG_PAYLOAD. The payload data SAT_SIG_PAYLOAD may include, for example, multimedia content (e.g., voice, video, pictures, etc.).

Still referring to step S404, in more detail the radio frequency (RF) filter 202 filters the received composite OTA signal z(t) to remove out of band noise and interference. The combiner 204 combines (adds or sums) the filtered composite OTA signal z(t) with an interference cancellation signal $y_{EST}(t)$ from the interference cancellation block 224. In this initial iteration, the interference cancellation signal $y_{EST}(t)$ is also zero because the transmission power at the terrestrial transmitter 222 is zero. Thus, the combined signal output from the combiner 204 is essentially the received satellite signal x(t) from the RF filter 202.

A low noise amplifier (LNA) 206 amplifies the combined signal, and outputs the amplified combined signal to a downconverter/analog-to-digital converter (ADC) block 208. The downconverter/ADC block 208 frequency-down-converts the combined signal to an intermediate frequency (IF) or baseband analog signal, and then further converts the analog combined signal to composite signal digital samples $z_n$. The composite signal digital samples $z_n$ are also referred to herein as a composite digital signal $z_n$ or a digital representation of the composite signal. The composite digital signal $z_n$ is composed of consecutive digital samples grouped into a plurality of blocks or frames. The manner in which a digital signal and/or samples are generated via digital sampling is well known in the art. Thus, a detailed discussion is omitted for the sake of brevity.

The downconverter/ADC block 208 outputs the composite digital signal $z_n$ to the interference cancellation block 224 and a satellite signal decoder 2102.

The satellite signal decoder 2102 decodes the composite digital signal $z_n$ to extract the payload data SAT_SIG_PAYLOAD. The satellite signal decoder 2102 outputs the payload data SAT_SIG_PAYLOAD to the terrestrial transmitter 222 and the interference cancellation block 224. The interference cancellation block 224 will be discussed in more detail later.

Returning to FIG. 4, at step S405, the terrestrial transmitter 222 generates the reference terrestrial signal y(t) to be transmitted based on the payload data SAT_SIG_PAYLOAD from the satellite receiver 102.

In more detail, at step S405 the modulator 2104 modulates the payload data SAT_SIG_PAYLOAD from the satellite signal decoder 2102 to generate digital samples $y_{SAT_SIG_PAYLOAD}$ including the payload data SAT_SIG_PAYLOAD. In one example, the modulator 2104 modulates the payload data SAT_SIG_PAYLOAD using orthogonal frequency division multiplexing (OFDM) as is well-known in the art. A digital-to-analog converter (DAC)/upconverter 212 then converts the digital samples $y_{SAT_SIG_PAYLOAD}$ into an analog signal and frequency upconverts the analog signal to an RF signal. In this case, the RF signal is the reference terrestrial signal y(t) to be transmitted from the terrestrial transmitter antenna 2220 once the transmission power of the terrestrial transmitter is increased (e.g., in subsequent iterations of the process shown in FIG. 4).

A high power amplifier (HPA) 214 amplifies the reference terrestrial signal y(t) from the DAC/upconverter 212, and the amplified reference terrestrial signal y(t) is output to the terrestrial transmitter antenna 2220 for transmission.

A coupler 220 obtains feedback of the reference terrestrial signal y(t), and outputs the obtained feedback to a downconverter/ADC 218. The downconverter/ADC 218 downconverts the reference terrestrial signal y(t) to an IF or baseband analog signal. The downconverter/ADC 218 also digitizes the reference terrestrial signal y(t) to generate a reference terrestrial digital signal $y_n$. The reference terrestrial digital signal $y_n$ is a digital copy or representation of the reference terrestrial signal y(t) to be transmitted by the terrestrial transmitter 222. In some instances, the reference terrestrial digital signal $y_n$ may be referred to as a digital representation of the reference terrestrial signal y(t). Similar to the composite digital signal $z_n$, the reference terrestrial digital signal $y_n$ is also composed of consecutive digital samples grouped into blocks or frames. The downconverter/ADC 218 outputs the reference terrestrial digital signal $y_n$ to the satellite receiver 102. More specifically, the downconverter/ADC 218 outputs the reference terrestrial digital signal $y_n$ to the interference cancellation block 224 at the satellite receiver 102.

As mentioned above, the interference cancellation block 224 also receives the composite digital signal $z_n$ from the downconverter/ADC 208 and the payload data SAY_SIG_PAYLOAD from the satellite signal decoder 2102.

Still referring to FIG. 4, at step S406 the interference cancellation block 224 generates interference cancellation signal $y_{EST}(t)$ based on composite digital signal $z_n$, the reference terrestrial digital signal $y_n$, and the payload data SAT_SIG_PAYLOAD. The interference cancellation signal $y_{EST}(t)$ is a modified version of the reference terrestrial signal y(t) transmitted by the terrestrial transmitter antenna 2220. More specifically, the interference cancellation signal $y_{EST}(t)$ is an opposite phase estimate of the terrestrial signal y(t) received at the satellite receiver 102; that is, approximately −y(t). In this example, the interference cancellation signal $y_{EST}(t)$ is substantially equal to, but has a phase opposite to, the terrestrial signal y(t). The interference cancellation block 224 outputs the interference cancellation signal $y_{EST}(t)$ to the combiner 204 such that the terrestrial signal component of the composite signal z(t) is suppressed at the satellite receiver 102. Thus, the output from the combiner 204 includes the satellite signal portion x(t) with suppressed (e.g., little or no) interference resulting from signals transmitted by the terrestrial transmitter 222, even as the output power of the terrestrial transmitter 222 is increased. Generation of the interference cancellation signal $y_{EST}(t)$ will be described in more detail later with regard to FIG. 3.

At step S410, the terrestrial transmitter 222 increases the transmission (output) power $P_{TER}$ of the reference terrestrial signal y(t) by an incremental amount. In one example, the terrestrial transmitter 222 increases the output power $P_{TER}$ of the reference terrestrial signal y(t) by about 0.1 dB.

At step S412, the terrestrial transmitter 222 determines whether the current transmission power $P_{TER}$ has reached a given, desired or predetermined transmission power level $P_{TH}$ by comparing the current transmission power $P_{TER}$ with the transmission power level $P_{TH}$. The transmission power level $P_{TH}$ may be determined by a network operator according to empirical data. In one example, the transmission power level $P_{TH}$ may be about 100 W. If the current transmission power $P_{TER}$ is greater than or equal to the transmission power level $P_{TH}$, then the process shown in FIG. 4 terminates.

Returning to step S412 in FIG. 4, if the current transmission power $P_{TER}$ is less than the transmission power level $P_{TH}$, then the terrestrial transmitter 222 transmits the reference terrestrial signal y(t) with the increased transmission power $P_{TER}$ at step S414.

The process then returns to step S404.

In the initial iteration of the process shown in FIG. 4, the transmission power of the reference terrestrial signal y(t) is set to zero. A second iteration of the process shown in FIG. 4 where the transmission power $P_{TER}$ is greater than zero will now be described for the sake of clarity. The second and subsequent iterations of the process shown in FIG. 4 are similar to the initial iteration discussed above, except with regard to step S404. Thus, only step S404 of the second iteration will be described in detail here.

Referring still to FIGS. 2 and 4, in this subsequent iteration the reference terrestrial signal y(t) has an output power that is greater than zero.

At step S404, the satellite receiver 102 processes the received composite OTA signal z(t) and extracts the satellite information (e.g., payload data) SAT_SIG_PAYLOAD.

In more detail, for example, the RF filter 202 filters the composite OTA signal z(t) to remove out of band noise and other interference. The combiner 204 then sums the filtered composite OTA signal z(t) with the interference cancellation signal $y_{EST}(t)$ output from the interference cancellation block 224. In this iteration, the terrestrial cancellation signal $y_{EST}(t)$ is substantially equal to, but has a phase opposite to, the reference terrestrial signal y(t). Thus, the terrestrial signal component of the composite OTA signal z(t) is substantially cancelled from the composite OTA signal z(t). The combiner 204 outputs the remainder of the composite OTA signal z(t) to the low noise amplifier (LNA) 206, and the process continues in the manner discussed above.

According to at least some example embodiments, because the power of the reference terrestrial signal y(t) is relatively low at the start, the received satellite signal x(t) is strong enough for the satellite signal decoder 2102 to continue to extract satellite information from the received satellite signal x(t).

The combiner 204 is able to suppress interference caused by signals transmitted by the terrestrial transmitter 222 from the composite OTA signal z(t) received at the satellite receiver 102. As a result, satellite information carried by the satellite signal x(t) may be extracted from the composite digital signal $z_n$ even as the signal power of the reference terrestrial signal y(t) at the terrestrial transmitter antenna 2220 increases. Therefore, the satellite signal decoder 2102 continues to extract satellite information from the satellite signal x(t) regardless, or independent, of the signal power of the terrestrial signal component of the composite signal z(t) at the satellite receiver 102.

As mentioned above, the process shown and described with regard to FIG. 4 may be repeated iteratively until the transmission power $P_{TER}$ of the reference terrestrial signal y(t) at the terrestrial transmitter 222 reaches the transmission power threshold $P_{TH}$.

The generation of the interference cancellation signal by the interference cancellation block 224 will now be described in more detail with regard to FIG. 3.

As mentioned above, FIG. 3 is a block diagram illustrating an example embodiment of the interference cancellation block 224 shown in FIG. 2 in more detail. As also mentioned above, the interference cancellation block 224 receives the composite digital signal $z_n$ from the downconverter/ADC 208 shown in FIG. 2, the reference terrestrial digital signal $y_n$ from the terrestrial transmitter 222, and the payload data SAT_SIG_PAYLOAD from the decoder 2102. The interference cancellation block 224 generates the interference cancellation signal $y_{EST}(t)$ based on the digital signals $z_n$ and $y_n$ and the payload data SAT_SIG_PAYLOAD.

In more detail, the interference cancellation block 224 includes a satellite signal reconstruction block 2248. The satellite signal reconstruction block 2248 generates a reconstructed satellite digital signal $x_{recon}$ based on the payload data SAT_SIG_PAYLOAD. In one example, the satellite signal reconstruction block 2248 generates the reconstructed satellite digital signal $x_{recon}$ by modulating the payload data SAT_SIG_PAYLOAD using, for example, quadrature-phase-shift-keying (QPSK). The reconstructed satellite digital signal $x_{recon}$ is a reconstructed version of a digital copy of the satellite signal x(t). The satellite signal reconstruction block 2248 outputs the reconstructed satellite digital signal $x_{recon}$ to combiner 2238.

The combiner 2238 combines the reconstructed satellite digital signal $x_{recon}$ with the composite digital signal $z_n$ from the downconverter/ADC 208. Specifically, the combiner 2238 subtracts the reconstructed satellite digital signal $x_{recon}$ from the composite digital signal $z_n$ to generate a terrestrial component of the composite digital signal $z_n$. In this example, the terrestrial component of the composite digital signal $z_n$ represents the remaining portion of the terrestrial signal y(t) not canceled from the composite signal z(t) at the combiner 204.

Figure 3:
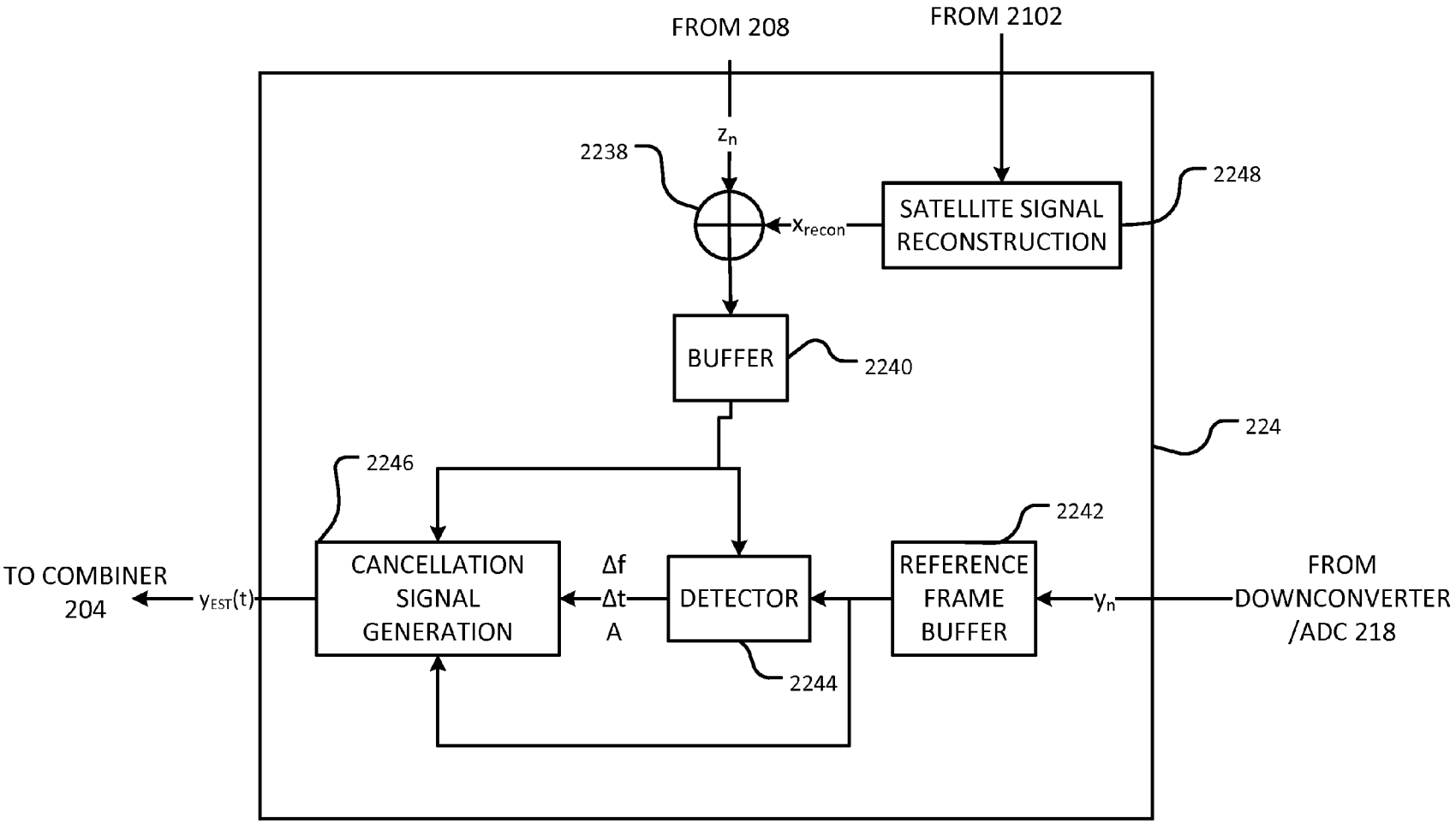
FIG. 3 is a block diagram illustrating an example embodiment of the interference cancellation block shown in FIG. 2.

Still referring to FIG. 3, the combiner 2238 outputs the terrestrial component of the composite digital signal $z_n$ to the buffer 2240. The interference cancellation block 224 stores a plurality of blocks of samples of the terrestrial component of the composite digital signal $z_n$ in the buffer 2240.

The interference cancellation block 224 also stores a block (e.g., current block) of samples of the reference terrestrial digital signal $y_n$ from the terrestrial transmitter in the reference frame buffer 2242. The reference terrestrial digital signal $y_n$ is a digital signal representing the reference terrestrial signal y(t). According to at least one example embodiment, the reference frame buffer 2242 may have the capacity to store 1 or 2 blocks of samples of the reference terrestrial digital signal $y_n$.

Still referring to FIG. 3, the detector 2244 estimates a time delay $\Delta\tilde{t}$ and frequency offset $\Delta\tilde{f}$ (e.g., channel characteristics) between the transmission and reception of the reference terrestrial signal y(t) at the satellite receiver 102 based on at least one block of samples from the reference frame buffer 2242 and the blocks of samples from the buffer 2240. An example process for estimating the time delay $\Delta\tilde{t}$ and frequency offset $\Delta\tilde{f}$ is described in detail in U.S. Patent Application Publication No. 2010/0008458 to H. Jiang et al. For the sake of clarity, an example process will be described below. The estimated time delay $\Delta\tilde{t}$ and frequency offset $\Delta\tilde{f}$ are output to the cancellation signal generation block 2246.

The cancellation signal generation block 2246 generates the interference cancellation signal $y_{EST}(t)$ based on the block of samples of the reference terrestrial digital signal $y_n$ stored in the reference frame buffer 2242, but with appropriately adjusted timing, phase and amplitude.

An example method for estimating time delay $\Delta\tilde{t}$ and frequency offset $\Delta\tilde{f}$ will now be described. In this example embodiment, the method is performed at the detector 2244 in FIG. 3. The method will be described, for the sake of clarity, with regard to an example situation in which the only distortion in the received OTA signal are actual time delay $\Delta t$, frequency offset $\Delta f$ and Gaussian noise. In this example, the received terrestrial signal is denoted $y_{RX}(\ )$, whereas the transmitted terrestrial signal is denoted $y_{TX}(\ )$.

$$y_{RX}(t)=\sqrt{P}y_{TX}(t-\Delta t)\cdot e^{2\pi\Delta f t}+\omega(t) \tag{1}$$

In Equation (1), P is the power of the received terrestrial signal $y_{RX}(t)$ relative to the transmission power of the transmitted terrestrial signal $y_{TX}(t)$, and $\omega(t)$ is the Gaussian noise. The actual time delay $\Delta t$ represents the round trip delay (RTD) of the signal traveling from the terrestrial transmitter 222 to the satellite receiver antenna 201. The actual frequency offset $\Delta f$ is a result of the Doppler effect due to satellite motion.

Assuming that the time delay $\Delta t$ is an integer multiple of sample duration T, each received sample $y_{RX_n}$ is given by Equation (2) shown below.

$$y_{RX_n}=\sqrt{P}y_{TX_n-M}\cdot e^{2\pi\Delta f t}+\omega_n \tag{2}$$

In the above equation, M is an additional delay with respect to the nominal delay D, expressed as a number of samples. The additional delay M is related to the time delay $\Delta t$ and given by Equation (3) shown below.

$$M=\frac{\Delta t}{T}-D \tag{3}$$

In Equation (3), M represents the instantaneous variation of the time offset with respect to the nominal offset D.

In estimating time delay and frequency offset, the detector 2244 calculates a correlation $C_k$ between a stored block of samples from reference frame buffer 2242 and the stored blocks of samples from buffer 2240. Each block of samples includes the same number of samples—namely N samples. The number N may be determined based on empirical data at a network controller.

The detector 2244 calculates the correlation $C_k$ between the block of samples from the reference frame buffer 2242 and each of the blocks of samples from the buffer 2240 according to Equation (4) shown below.

$$C_k=\Sigma_{n=0}^{N-1}y_{RXn+k}\cdot(y_{TXn})^*\cdot(y_{RXn+k+q}\cdot(y_{TXn+q})^*)^* \tag{4}$$

In Equation (4), the '$y_{TXn}$' notation represents the samples from the reference frame buffer 2242 and the '$y_{RXn}$' notation represents the samples from the buffer 2240. The notation ( )* represents complex conjugate, and q is a parameter that indicates the distance between the samples represented by $y_{RXn+k}$ and $y_{RXn}$ and respective samples $y_{TXn+k}$ and $y_{TXn}$. According to example embodiments, parameter q determines the accuracy of the frequency offset estimate. The larger q becomes, the more accurate the estimate becomes. The value of q may be determined experimentally for a given accuracy requirement. Typically, q may be on the order of between about 10N to about 100N. A correlation is computed for each block of received samples in the buffer 2240, which are indexed by k=0, ±1, ±2, . . . , K.

According to example embodiments, a single correlation $C_k$ given by Equation (4) is used to estimate both time delay and frequency offset between signals. The estimate of the time delay $\Delta\tilde{t}$ is obtained by maximizing the amplitude of correlation $C_k$ over index k=0, ±1, ±2, . . . , ±K. That is, the time delay is estimated by identifying the index k associated with the maximum correlation value $C_k$. As discussed herein, the maximum correlation value is referred to as $C_{k_{max}}$ and the index k associated with the maximum correlation $C_{k_{max}}$ is referred to as $k_{max}$. In this example, $k_{max}$ represents a location of the block of samples associated with the maximum correlation within a plurality of blocks of samples from the buffer 2240.

In one example, identification of the maximum correlation $C_{k_{max}}$ may be regarded as searching within a given or desired search window [−K, K], for some K>0 as represented by Equation (5) shown below.

$$|C_{k_{max}}|=\max\{|C_k|,-K\leq k\leq K\} \tag{5}$$

The estimated time delay $\Delta\tilde{t}$ is then calculated based on the index $k_{max}$ associated with the maximum correlation value $C_{k_{max}}$ as shown below in Equation (6).

$$\Delta\tilde{t}=(D+k_{max})T \tag{6}$$

As noted above, D is the nominal delay and T is the sample duration. Stated another way, the estimated time delay $\Delta\tilde{t}$ may be calculated as a function of the index $k_{max}$, the nominal delay D and the sample duration T.

According to example embodiments, the estimated time delay $\Delta\tilde{t}$ given by Equation (6) is valid when the condition given by Equation (7) is met.

$$(D-K)T\leq\Delta t\leq(D+K)T \tag{7}$$

Consequently, in choosing the search window [−K, K], the values of D and K are chosen such that condition (7) is satisfied. The search window [−K, K] may be selected automatically or by a human network operator based on empirical data.

The frequency offset is also estimated based on the maximum correlation value $C_{k_{max}}$. In more detail, the frequency offset is estimated based on the phase of the maximum correlation value $C_{k_{max}}$; that is, the correlation value $C_k$ evaluated at the index $k_{max}$.

The estimated frequency offset $\Delta\tilde{f}$ between the transmitted and received terrestrial signals is given by Equation (8) shown below.

$$\Delta\tilde{f}=\frac{-1}{2\pi qT}\arg(C_{k_{max}}) \tag{8}$$

As noted above, q is a parameter indicating a distance between pairs of samples and T is the sample duration used in generating the samples. The value $\arg(C_{k_{max}})$ is the phase of the correlation $C_k$ evaluated at $k_{max}$. Because computation of the phase of a complex number is well known in the art, only a brief discussion will be provided. In one example, $\arg(C_{k_{max}})$ may be computed according to Equation (9) shown below:

$$\arctan\left(\frac{\mathrm{Im}(C_{k_{max}})}{\mathrm{Re}(C_{k_{max}})}\right) \tag{9}$$

In Equation (9), $\mathrm{Im}(C_{k_{max}})$ is the imaginary part of complex number $C_{k_{max}}$, and $\mathrm{Re}(C_{k_{max}})$ is the real part of the complex number $C_{k_{max}}$.

According to example embodiments, the estimated time delay $\Delta\tilde{t}$ and frequency offset $\Delta\tilde{f}$ are used in the cancellation signal generation block 2246 to adjust the time and frequency of the reference terrestrial signal y(t) in order to generate the cancellation signal $y_{EST}(t)$. The cancellation signal generation block 2246 is designed to adjust for the time delay and frequency offsets such that $\Delta\tilde{t}=D\cdot T$ and $\Delta\tilde{f}=0$ in the steady state.

Still referring to FIG. 3, the cancellation signal generation block 2246 determines the amplitude A of the cancellation signal $y_{EST}(t)$ by examining the errors after having properly adjusted the cancellation signal $y_{EST}(t)$ for timing and frequency offset. Because the manner in which the cancellation signal generation block 2246 determines the amplitude A is well-known, a detailed discussion is omitted.

Figure 5:
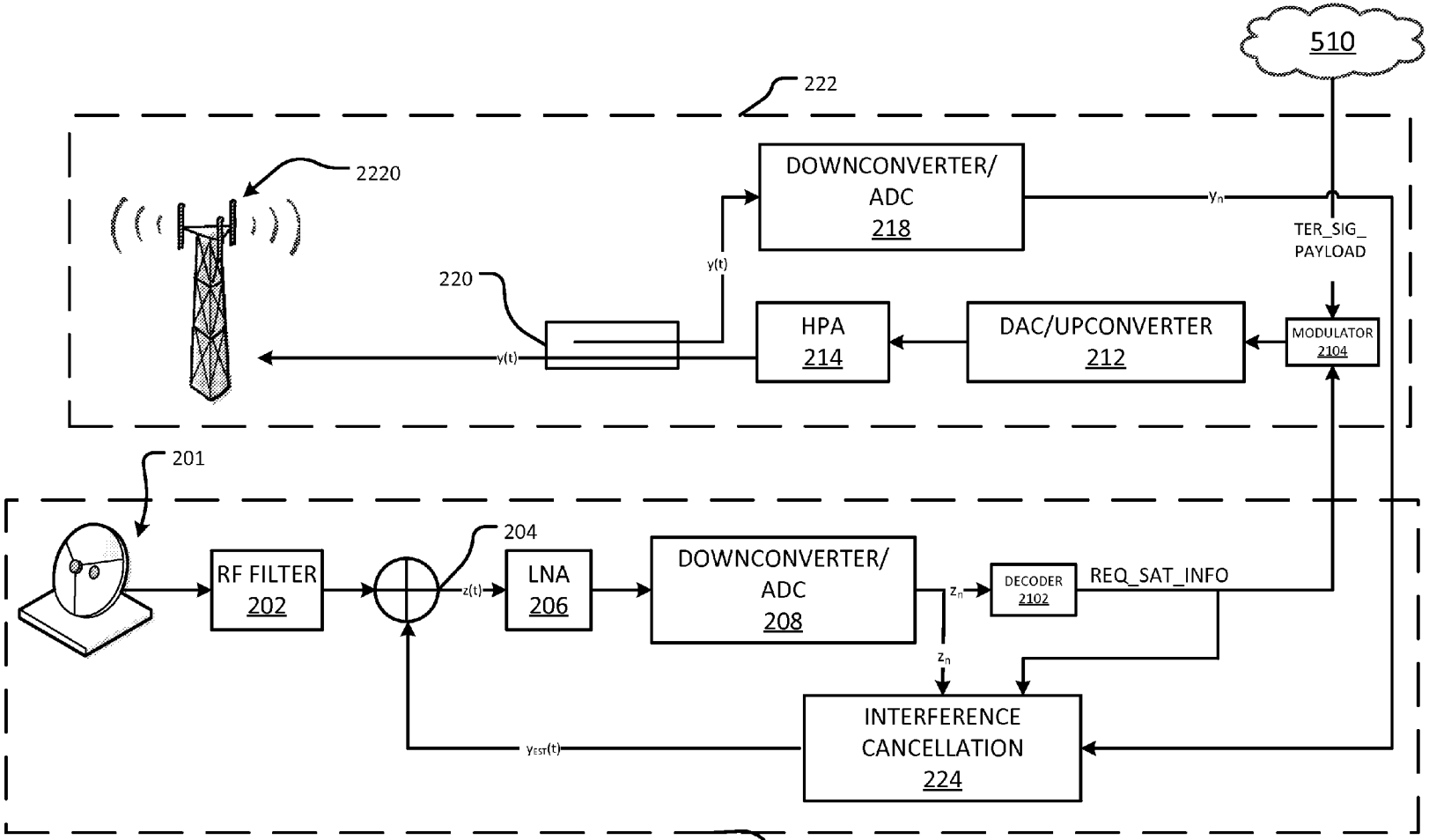
FIG. 5 is a block diagram illustrating another example embodiment of a terrestrial transmitter and a satellite receiver in more detail.

FIG. 5 is a system block diagram illustrating a satellite receiver and terrestrial transmitter according to another example embodiment. The example embodiment shown in FIG. 5 will be described (and may be implemented) in conjunction with a DVB-SH network.

The example embodiment shown in FIG. 5 is similar to the example embodiment shown in FIG. 2, and thus, only differences between the embodiments will be described herein.

In the example embodiment shown in FIG. 5, the payload data carried by the terrestrial signal y(t) transmitted by the terrestrial transmitter 222 is not extracted from the satellite signal by the satellite signal decoder 2102. Instead, the payload data carried by the terrestrial signal y(t), which is denoted "TER_SIG_PAYLOAD" in FIG. 5, is provided by an auxiliary network 510. The auxiliary network 510 may be any suitable backhaul network (e.g., Ethernet, fiber optic, etc.).

Rather than extracting payload data SAT_SIG_PAYLOAD as in the example embodiment shown in FIG. 2, in the example embodiment shown in FIG. 5 the satellite information extracted by the satellite signal decoder 2102 is required satellite information REQ_SAT_INFO. In one example, the required satellite information REQ_SAT_INFO is the time delay Δt and frequency offset Δf (channel characteristics) needed by the terrestrial transmitter 222 to modulate the terrestrial signal payload data TER_SIG_PAYLOAD from the auxiliary network 510.

The satellite signal decoder 2102 outputs the required satellite information REQ_SAT_INFO to the modulator 2104 of the terrestrial transmitter 222, which then modulates the payload data TER_SIG_PAYLOAD accordingly to generate digital samples $y_{TER_SIG_PAYLOAD}$. The example embodiment shown in FIG. 5 then functions as discussed above with regard to FIG. 2, except with regard to the digital samples $y_{TER_SIG_PAYLOAD}$.

In the example embodiment shown in FIG. 5, the interference cancellation block 224 generates the cancellation signal $y_{EST}(t)$ as discussed above with regard to, for example, FIG. 3. The interference cancellation block 224 operates in substantially the same manner as described above, except that the required satellite information REQ_SAT_INFO is input to the satellite signal reconstruction block 2248, rather than the payload data SAT_SIG_PAYLOAD.

According to at least some example embodiments, information regarding the satellite signal, which is required by the terrestrial transmitter, may be obtained from the satellite signal at the location of the terrestrial transmitter. Advantageously, in accordance with at least some example embodiments, this information need not be transmitted by another (e.g., auxiliary) transmission network and the required information may be obtained more accurately.

The foregoing description of example embodiments has been provided for purposes of illustration and description. It is not intended to be exhaustive or to limit the disclosure. Individual elements or features of a particular example embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for cancelling interference caused by a terrestrial transmitter at a satellite receiver in a hybrid satellite-terrestrial network, the method comprising:

modulating payload data including multimedia content, the payload data being part of satellite information obtained from a satellite signal component of a received over-the-air (OTA) signal;

generating a reference terrestrial signal based on the modulated payload data;

generating, at the satellite receiver, an interference cancellation signal based on the reference terrestrial signal and the received OTA signal, the interference cancellation signal being a modified version of the reference terrestrial signal; and cancelling, at the satellite receiver, the interference caused by the terrestrial transmitter by combining the interference cancellation signal with the received OTA signal.

2. The method of claim 1, wherein the generating the interference cancelation signal comprises:

adjusting channel characteristics of the reference terrestrial signal to generate the interference cancellation signal.

3. The method of claim 2, wherein the channel characteristics include at least one of frequency, timing and amplitude.

4. The method of claim 1, wherein the reference terrestrial signal is generated by the terrestrial transmitter.

5. The method of claim 1, wherein the satellite information further includes channel characteristics for the satellite signal component.

6. The method of claim 5, wherein the channel characteristics include frequency and timing offset information for the satellite signal component.

7. The method of claim 1, wherein the satellite information further includes channel characteristics; and the modulating further includes modulating the payload data including the multimedia content based on the channel characteristics.

8. The method of claim 1, wherein the generating the interference cancelation signal comprises:

obtaining the satellite information from the satellite signal component of the received OTA signal;

generating a reconstructed satellite digital signal based on the satellite information;

combining the reconstructed satellite digital signal with a digital representation of the received OTA signal to obtain a terrestrial digital signal component of the digital representation of the received OTA signal;

detecting channel characteristics associated with the reference terrestrial signal based on the terrestrial digital signal component and a digital representation of the reference terrestrial signal; and generating the interference cancellation signal based on the detected channel characteristics.

9. The method of claim 8, wherein the channel characteristics include at least time delay and frequency offset between transmission and reception of the reference terrestrial signal at the satellite receiver.

10. The method of claim 1, wherein the interference cancellation signal is a signal that is substantially equal to, but opposite in phase from, the reference terrestrial signal.

11. The method of claim 1, wherein the satellite signal component of the received OTA signal and the reference terrestrial signal carry the same data.

12. A method for cancelling interference caused by a terrestrial transmitter at a satellite receiver in a hybrid satellite-terrestrial network, the method comprising:

generating, at the satellite receiver, an interference cancellation signal based on a reference terrestrial signal from the terrestrial transmitter and a received over-the-air (OTA) signal, the interference cancellation signal being a modified version of the reference terrestrial signal;

cancelling, at the satellite receiver, the interference caused by the terrestrial transmitter by combining the interference cancellation signal with the received OTA signal;

increasing a transmission power of the reference terrestrial signal;

comparing the transmission power of the reference terrestrial signal with a transmission power level; and determining whether to transmit the reference terrestrial signal based on the comparing step.

13. The method of claim 12, wherein the reference terrestrial signal is transmitted if the increased transmission power is less than the transmission power level.

14. A satellite receiver comprising:

an interference cancellation block configured to generate an interference cancellation signal based on a reference terrestrial signal from a terrestrial transmitter and a received over-the-air (OTA) signal, the interference cancelation signal being a modified version of the reference terrestrial signal;

a first combiner configured to combine the interference cancellation signal with the received OTA signal to cancel interference caused by the terrestrial transmitter in a hybrid satellite-terrestrial network; and a satellite signal decoder configured to obtain satellite information from a satellite signal component of the received OTA signal; wherein the satellite information is payload data including multimedia content, the payload data is modulated, and the reference terrestrial signal is generated based on the modulated payload data.

15. The satellite receiver of claim 14, wherein the interference cancellation block is configured to adjust channel characteristics of the reference terrestrial signal to generate the interference cancellation signal.

16. The satellite receiver of claim 14, wherein the reference terrestrial signal is generated by the terrestrial transmitter.

17. The satellite receiver of claim 14, wherein the satellite information further includes channel characteristics for the satellite signal component.

18. The satellite receiver of claim 14, wherein the interference cancellation block includes, a reconstruction block configured to generate a reconstructed satellite digital signal based on the satellite information, a second combiner configured to combine the reconstructed satellite digital signal with a digital representation of the received OTA signal to obtain a terrestrial digital signal component of the digital representation of the received OTA signal, a detector configured to detect channel characteristics associated with the reference terrestrial signal based on the terrestrial digital signal component and a digital representation of the reference terrestrial signal, and an interference cancellation signal generation block configured to generate the interference cancellation signal based on the detected channel characteristics.

19. An interference cancellation system for a hybrid satellite-terrestrial network, the system comprising:

a terrestrial transmitter configured to compare a transmission power of a reference terrestrial signal with a transmission power level, and to transmit the reference terrestrial signal if the transmission power is less than the transmission power level; and a satellite receiver including, an interference cancellation block configured to generate an interference cancellation signal based on the reference terrestrial signal and a received over-the-air (OTA) signal, the interference cancelation signal being a modified version of the reference terrestrial signal, and a combiner configured to combine the interference cancellation signal with the received OTA signal to cancel interference caused by the terrestrial transmitter in the hybrid satellite-terrestrial network.

* * * * *